US009903156B2

(12) United States Patent
Lee

(10) Patent No.: US 9,903,156 B2
(45) Date of Patent: Feb. 27, 2018

(54) CUTTING MACHINE FOR WINDOW COVERING

(71) Applicant: NIEN MADE ENTERPRISE CO., LTD., Taichung (TW)

(72) Inventor: Wen-Yeu Lee, Tainan (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 252 days.

(21) Appl. No.: 14/667,444

(22) Filed: Mar. 24, 2015

(65) Prior Publication Data

US 2015/0197982 A1 Jul. 16, 2015

Related U.S. Application Data

(63) Continuation-in-part of application No. 13/852,339, filed on Mar. 28, 2013, now Pat. No. 9,068,393.

(51) Int. Cl.

| | |
|---|---|
| ***E06B 9/266*** | (2006.01) |
| ***B26D 5/10*** | (2006.01) |
| ***B26D 7/04*** | (2006.01) |
| ***B26D 1/08*** | (2006.01) |
| ***B26D 3/16*** | (2006.01) |
| *B26D 1/00* | (2006.01) |
| *B26D 7/01* | (2006.01) |

(52) U.S. Cl.

CPC ..... *E06B 9/266* (2013.01); *B26D 1/08* (2013.01); *B26D 3/16* (2013.01); *B26D 7/04* (2013.01); *B26D 3/166* (2013.01); *B26D 5/10* (2013.01); *B26D 2001/006* (2013.01); *B26D 2007/013* (2013.01); *Y10T 83/7487* (2015.04); *Y10T 83/7567* (2015.04); *Y10T 83/885* (2015.04); *Y10T 83/8854* (2015.04)

(58) Field of Classification Search

CPC .. E06B 9/266; B26D 1/08; B26D 5/10; B26D 3/166; B26D 2007/013; B26D 7/04; B26D 3/16; B26D 2001/006; Y10T 83/7487; Y10T 83/885; Y10T 83/7567; Y10T 83/8854

USPC .... 83/167, 614, 613, 651, 697, 620; 30/316, 30/337, 343

See application file for complete search history.

(56) References Cited

U.S. PATENT DOCUMENTS

| | | | | |
|---|---|---|---|---|
| 3,245,296 | A * | 4/1966 | Valente | B23D 35/008 83/162 |
| 3,301,117 | A * | 1/1967 | Spaulding | B26D 1/105 83/455 |
| 3,961,858 | A * | 6/1976 | Smith | B23B 51/0406 408/204 |
| 5,279,196 | A * | 1/1994 | Mohr | B26D 7/015 414/907 |
| 6,435,066 | B1 | 8/2002 | Kutchmarek et al. | |

(Continued)

*Primary Examiner* — Ghassem Alie

(74) *Attorney, Agent, or Firm* — Lynette Wylie; Apex Juris, pllc.

(57) ABSTRACT

A cutting machine for cutting window coverings includes a machine base, on which a cutting device and a clamping device are mounted. The cutting device has a cutter. A blade edge of the cutter is oblique to a sustaining face, on which the window covering is rested, of the machine base. It is beneficial to cut a first rail, a covering material, and a second rail of the window covering in sequence. The cutting machine may cut the window covering with a flat cutting facet to have a good cutting quality and also extend the life of the cutter.

11 Claims, 10 Drawing Sheets

(56) References Cited

U.S. PATENT DOCUMENTS 7,000,521 B1 * 2/2006 Cheng ..... B26D 1/08
83/631
7,204,180 B2 * 4/2007 Schwaiger ..... B26D 1/0006
83/613

* cited by examiner

CUTTING MACHINE FOR WINDOW COVERING

CROSS REFERENCE TO RELATED APPLICATIONS

This application is a continuation-in-part of U.S. patent application Ser. No. 13/852,339 filed on Mar. 28, 2013. The content of the above-referenced application is incorporated by reference herein.

BACKGROUND OF THE INVENTION

1. Technical Field

The present invention relates generally to a window covering, and more particularly to a cutting machine for cutting rails and window covering material of a window covering.

2. Description of Related Art

Typically, there are a variety of sizes of windows, so the manufactures sell the window coverings to retailers, and the retailers cut the window covering to fit a specific window. A conventional cutting machine for cutting a window covering is taught in U.S. Pat. No. 6,435,066 (hereafter the '066 patent), titled "Cutting apparatus for window covering and methods therefor", which provides a cutting device on a machine base to cut the window covering.

The '066 patent teaches that a blade, which is used to cut the window coverings, has to simultaneously touch the headrail, the bottom rail, and the window covering material before cutting. However, when the cutting machine of the '066 patent is used to cut a blind with a cellular shade or slats, it would have an uneven cutting result when the blinds are not pressed enough. Therefore, the key to have a nice cutting result is how to firmly press the blinds. However, the clamping device of the '066 patent can't provide sufficient clamping force. On the contrary, if power of the clamping device is too large, it might damage some slats of the blinds.

Furthermore, the '066 patent teaches that the blade simultaneously touches the headrail, the bottom rail, and the window covering material before cutting. It makes the user have to exert a large strength to cut the window coverings, and sometime it will damage the elements with such large strength. Beside, the '066 patent provides a rigid machine base to sustain the window coverings that would damage the blade after the blade cutting the window coverings several times, and that is bad to the afterwards cutting tasks.

BRIEF SUMMARY OF THE INVENTION

The primary objective of the present invention directs to a cutting machine for a window covering, which could evenly cut the window covering with a good cutting quality.

The secondary objective of the present invention directs to a cutting machine for a window covering, which provides a design for a safe operation, and a controllable clamping force.

In order to achieve the objectives of the present invention, the present invention provides a cutting machine for cutting a window covering, wherein the window covering includes a first rail, a covering material, and a second rail, the cutting machine including a machine base having a sustaining face for putting the window covering thereon; and a cutting device provided on the machined base, and including a cutter, which is controllable to reciprocate in a direction substantially perpendicular to the sustaining face, wherein the cutter has a blade edge, and an angle is formed between the blade edge and the sustaining face to cut the first rail, the covering material, and the second rail of the window covering in sequence.

In an embodiment, the angle between the blade edge and the sustaining face is between the 0 and 90 degrees.

In an embodiment, the machine base is provided with a non-rigid pad, and the sustaining face is formed on the non-rigid pad; the cutter crosses an edge of the non-rigid pad and is adjacent to the edge of the non-rigid pad when the cutter is moved to cut the window covering.

In an embodiment, the machine base further includes a rigid board and a guiding board; the non-rigid pad and the guiding board are fixed to the rigid board, and a cutting slot is formed between non-rigid pad and the guiding board for the cutter to pass therethrough; the rigid board is provided with a discharging opening, which is lower than the sustaining face; and a waste part of the window covering after being cut leaves the machine base through the guiding board and the discharging opening in sequence.

In an embodiment, the cutting device further includes a frame and a control bar; the cutter is slidably connected to the frame for reciprocation; the control bar is pivoted on the frame to be moved between a first position and a second position; and the cutter is moved by moving the control bar.

In an embodiment, the cutting device further includes a positioning post and a locker; the positioning post is fixed to the frame; the locker is pivoted on the control bar; the locker has a hook to engage the positioning post when the control bar is moved to the first position, and disengages the positioning post when the control bar is moved to the second position.

In an embodiment, the cutting device further includes a stopping member fixed to the locker to separate the control bar from the hook.

In an embodiment, the hook of the locker has a round edge to abut against the positioning post and move the locker off when the control bar is being moved to the first position from the second position, and then the locker automatically moves back to engage the positioning post because of gravity when the control bar arrives at the first position.

In an embodiment, the cutting device further includes a connecting bar, a stopping block, and a movable block; the connecting bar is pivotally connected to the frame to drive the stopping block to reciprocate along the machine base; the connecting bar has an elongated slot; the elongated slot is oblique to an axial line, which is perpendicular to the sustaining face; the movable block has a portion received in the elongated slot to be moved along with the control bar between a third position and a fourth position; the movable block drives the connecting bar to move when the movable block is moved between the third position and the fourth position; the connecting bar drives the stopping block to move toward the cutter when the movable block is moved to the third position, and the connecting bar drives the stopping block to move away from the cutter when the movable block is moved to the fourth position.

In an embodiment, the cutting device further includes at least one bar; the at least one bar has an end proximal to the sustaining face and an end distal to the sustaining face; the stopping block is connected to the at least one bar, and is movable on the at least one bar and fixed at a position by operating a knob.

In an embodiment, the cutting machine of the present invention further includes a clamping device having two fixed bases, a clamping block, a screw rod, an operating wheel, and a spring. The fixed bases are mounted on the machine base, the clamping block is movable between the fixed bases, the screw bar is fixed to the fixed bases while the clamping block is screwed with the screw bar, and the operating wheel is fixed to an end of the screw bar; the spring fits the screw bar and has opposite ends urging the operating wheel and one of the fixed bases, whereby the clamping block is moved between the fixed bases by turning the operating wheel.

In an embodiment, the clamping device further includes a first stopping block and a second stopping block; the first stopping block is fixed to the operating wheel, and the second stopping block is fixed to one of the fixed bases; turning the operating wheel will make the first stopping block abut against the second stopping block that makes the operating wheel may not be turned anymore.

With the design of above, the cutting machine of the present invention could provide the window covering a stable and consistent clamping force that could have a nice cutting task. The present invention further provides several function, including safe operation, automatically collecting the waste parts of the window covering after being cut, and elongating the life of the cutter.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
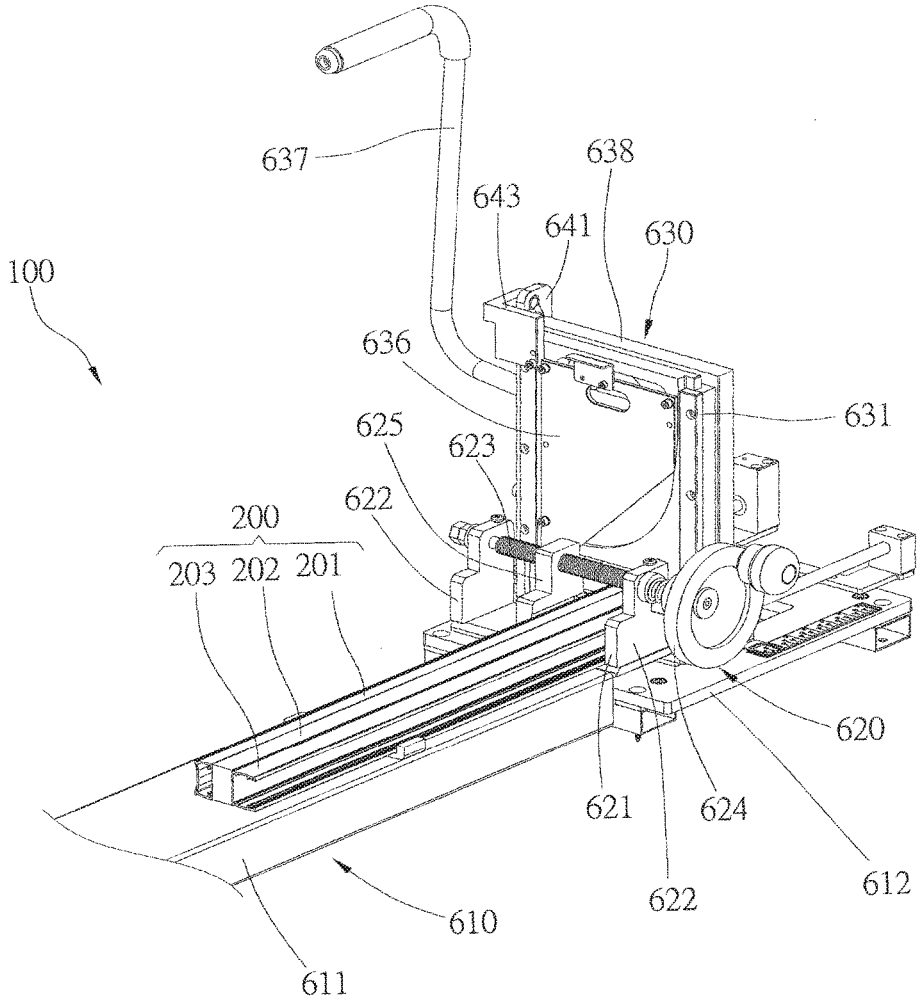
FIG. 1 is a perspective view of a preferred embodiment of the present invention.
Figure 2:
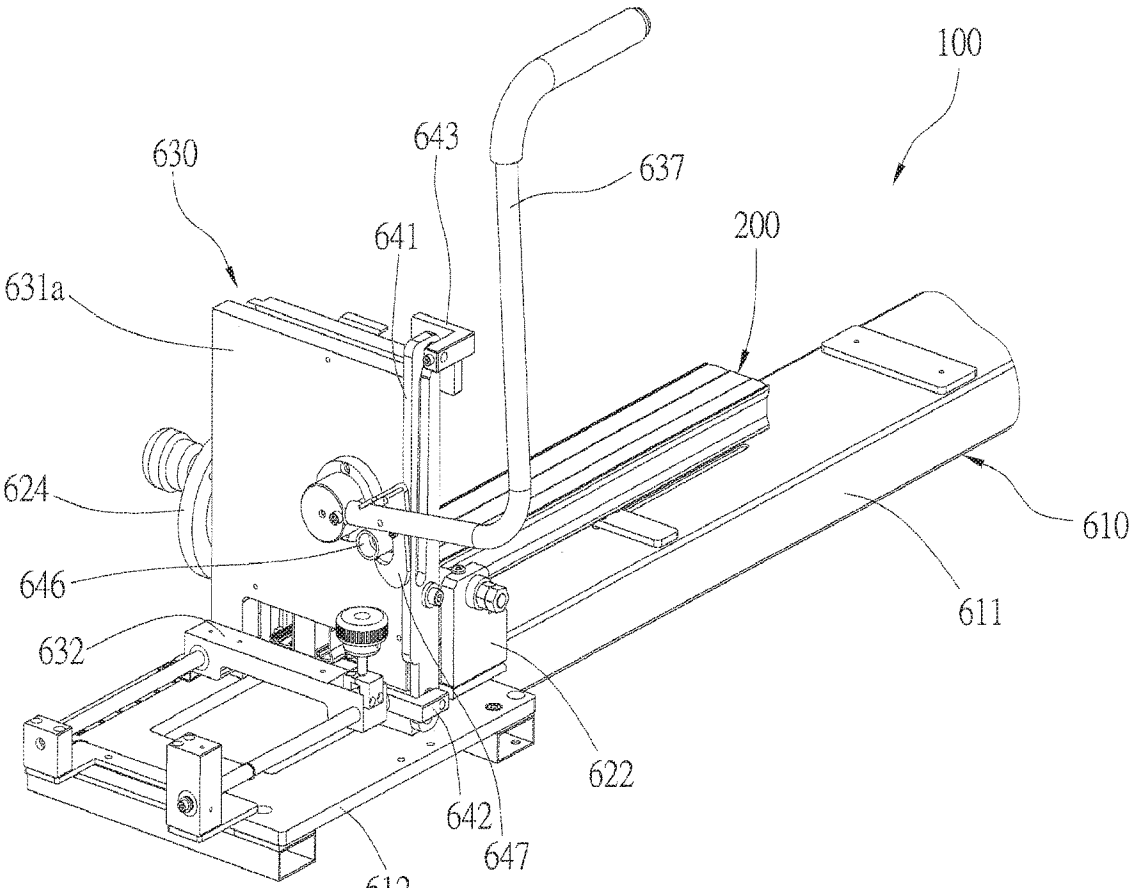
FIG. 2 is another perspective view of the preferred embodiment of the present application.

As shown in FIG. 1 and FIG. 2, a cutting machine 100 of the preferred embodiment of the present invention is used to cut a window covering including a first rail 201, a covering material 202, and a second rail 203. The covering material could be a cellular shade or slats, and the first rail 201 could be a headrail of the covering material 202 while the second rail 203 is a bottom rail, or reverse. The cutting machine 100 includes a machine base 610, a clamping device 620, and a cutting device 630.

As shown in FIGS. from FIG. 3 to FIG. 6, the machine base includes a main rail 611, a rigid board 612, a non-rigid pad 613, and a guiding board 614. The main rail 611 and the rigid board 612 are connected together for the window covering to stably rest thereon. The rigid board 612 has an elongated cutting slot 612*a* (FIG. 6) and a discharging opening 612*b* next to the cutting slot 612*a*. The non-rigid pad 613 is fixed to the rigid board 612, and has a flat sustaining face 613*a* on a top side thereof to sustain the window covering 200. The guiding board 614 is fixed to the rigid board 612 in an oblique direction, and has a guiding surface 614*a* which slopes towards the discharging opening 612*b*. The cutting slot 612*a* of the rigid board 612 is between the non-rigid pad 613 and the guiding board 614, and the discharging opening 612*b* is lower than the sustaining face 613*a* of the non-rigid pad 613.

Figure 5:
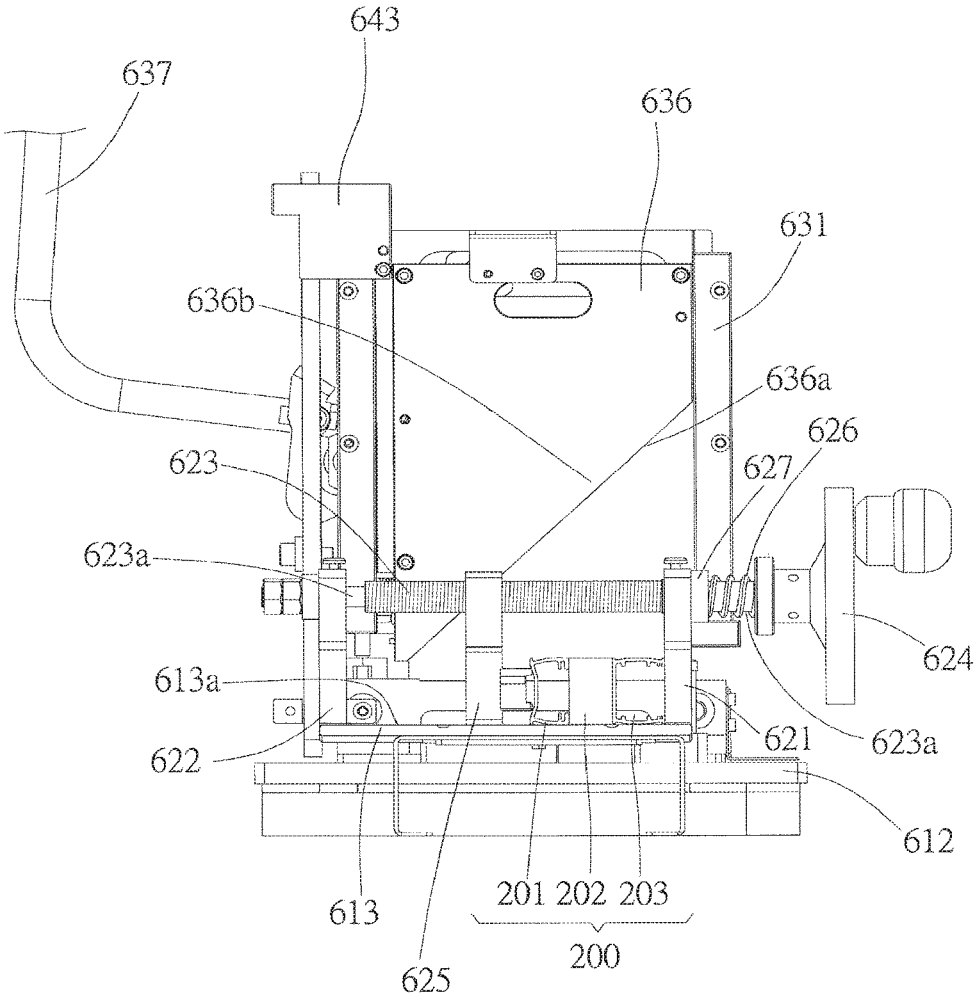
FIG. 5 is a rear view of FIG. 3.

As shown in FIG. 5, the clamping device 620 is mounted on the machine base 610 to firmly hold the window covering 200 for the cutting operation. The clamping device 620 includes two fixed bases 621, 622, a screw rod 623, an operating wheel 624, and a clamping block 625. The fixed bases 621, 622 are fixed to the machine base 610, and keep a distance from each other. The screw rod 623 has two round sections 623*a* passing through the fixed bases 621, 622 respectively, so that the screw rod 623 is able to move in an axial direction and rotate. The operating wheel 624 is connected to an end of the screw rod 623 to be operated by a user to rotate the screw rod 623 in both directions. The clamping block 625 is provided with a threaded hole (not shown) to be meshed with a thread section, which is between the round sections 623*a*, of the screw rod 623. Therefore, when the operating wheel 624 is turned, the clamping block 625 moves on the screw rod 623 between the fixed bases 621, 622. The window covering 200 is place in a space between the clamping block 625 and the fixed base 621 to be clamped by turning the operating wheel 624. It is noted that while the operating wheel 624 is being overturned, the screw rod 623 is moving toward the fixed base 622 instead of the clamping block 625 that could limit the pressure on the window covering 200.

Figure 7:
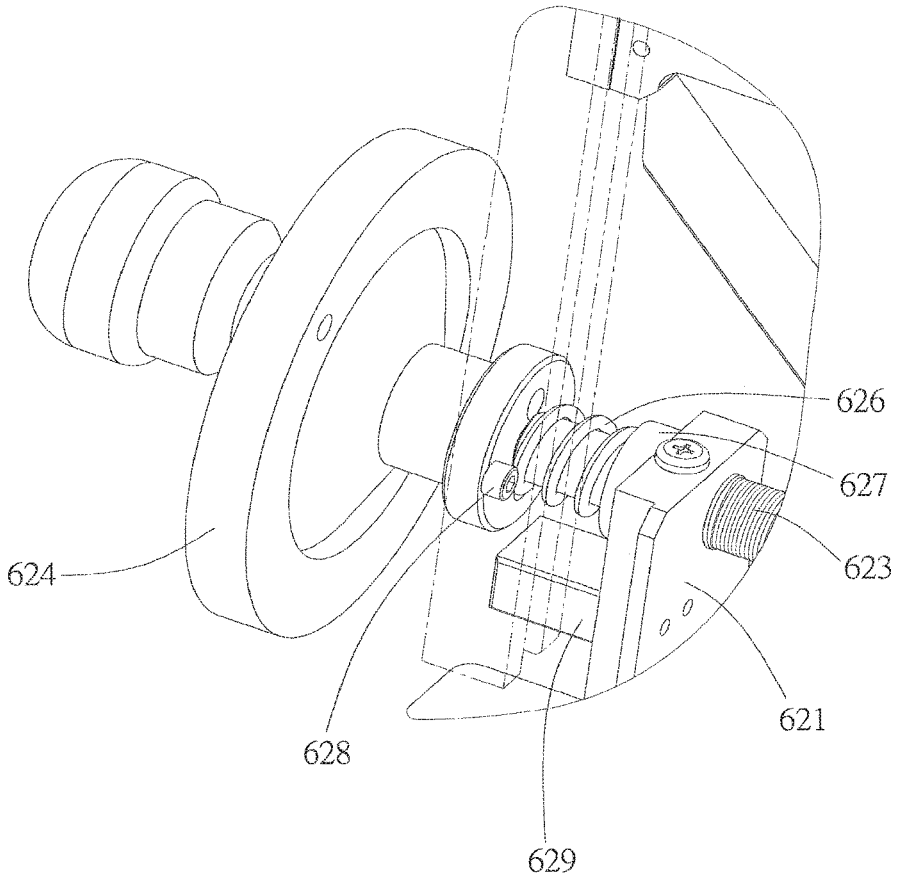
FIG. 7 is a partial perspective view of the preferred embodiment of the present invention, showing the relative positions between the first stopping block and the second stopping block.

The clamping device 620 further includes a spring 626, a hub 627, a first stopping block 628, and a second stopping block 629. The spring 626 and the hub 627 fit the round section 623*a* of the screw rod 623, the hub 627 abuts against the fixed base 621, and the spring 626 has opposite ends urging the hub 627 and the operating wheel 624 respectively. As shown in FIG. 7, the first stopping block 628 is fixed to the operating wheel 624 to move together with the operating wheel 624. The second stopping block 629 is fixed to the fixed base 621. While the operating wheel 624 keeps being turned, the screw rod 623 is moved toward the fixed base 622 until the first stopping block 628 abuts against the second stopping block 629 that results in the operating wheel 624 not being turned anymore. At the same time, the spring 626 urges the operating wheel 624 in a direction opposite to that of the screw rod 623 to hold the clamping block 625 at a position which may firmly press the window covering 200. As a result, the clamping device 620 would provide the window covering a suitable and consistent pressure which is benefit to the following cutting operation, and would not damage the window covering 200.

The cutting device 630 is mounted on the rigid board 612 of the machine base 610 and adjacent to the clamping device 620 which has several functions, including cutting the window covering 20 in a safe way, blocking the window covering, and discharging the window covering. The detail of the cutting device 630 is hereafter.

Figure 3:
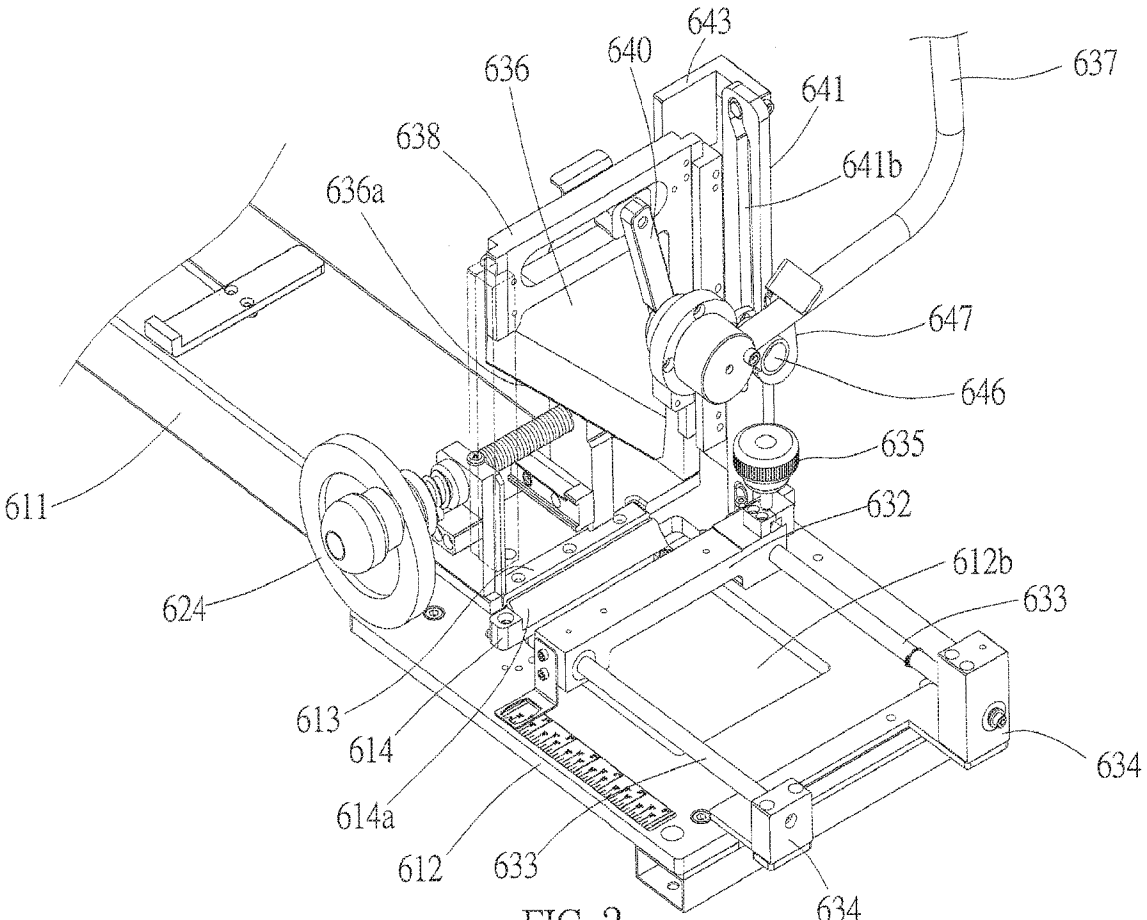
FIG. 3 is a partial perspective view of the preferred embodiment of the present application.
Figure 4:
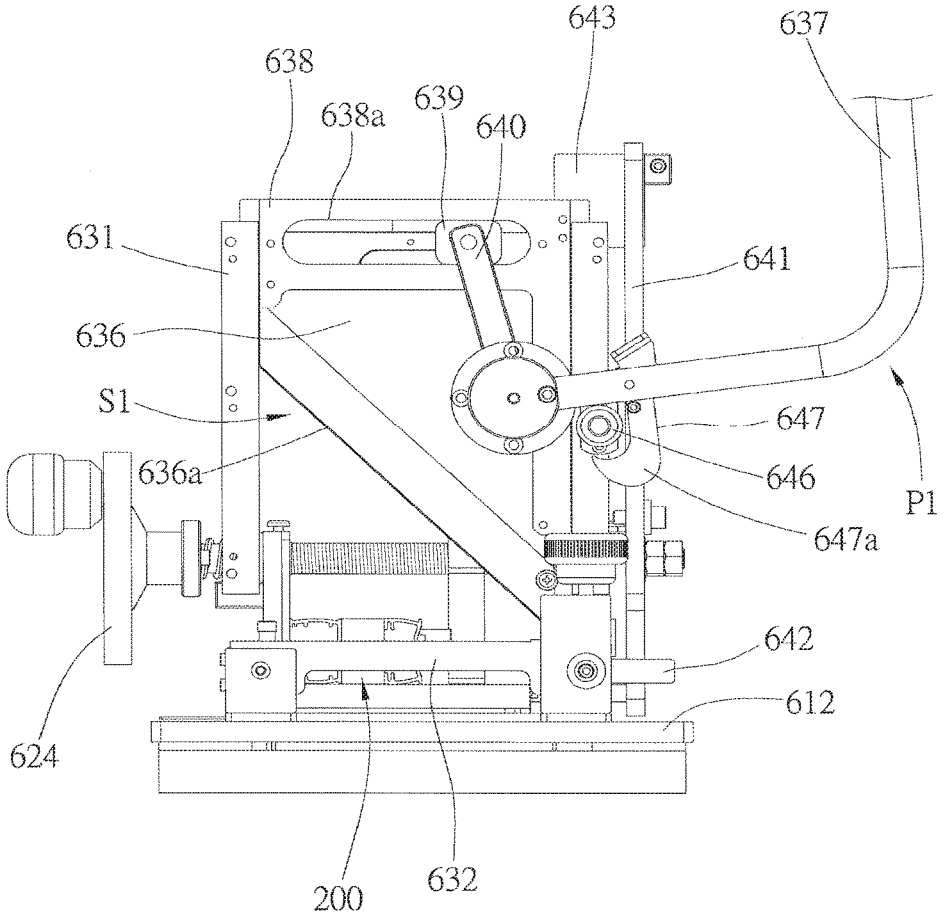
FIG. 4 is a front view of FIG. 3, showing the control bar at the first position and the cutter at the pre-cut position.

The cutting device 630 includes a frame 631 and a stopping block 632. The frame 631 is vertically mounted on the rigid board 612 and between the clamping device 620 and the stopping block 632. As shown in FIG. 3, the stopping block 632 is fixed to two bars 633, and each of the bars 633 pass through a fixed block 634 to reciprocate the stopping block 632 along the machine base 610 and relative to the frame 631. An end of the window covering 200 abuts against the stopping block 632 for the following cutting operation. A knob 635 is provided to be operated to lock and unlock the stopping block 632 that could move and position the stopping block 632 at any desired position on the bars 633. It controls a length of the window covering 200 to be cut.

Figure 8:
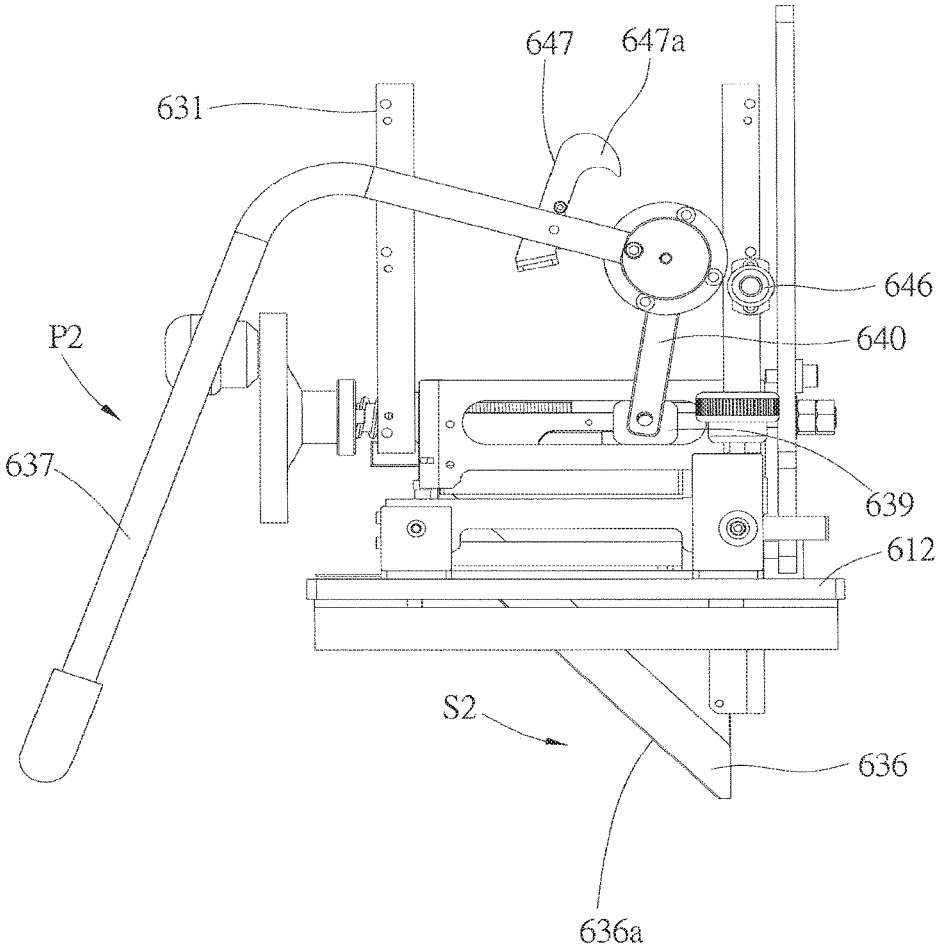
FIG. 8 is a front view of FIG. 3, showing the control bar at the second position and the cutter at the post-cut position.

As shown in FIGS. from FIG. 1 to FIG. 8, the cutting device 630 further includes a cutter 636 and a control bar 637. The cutter 636 is fixed to a guiding block 638, and the guiding block 638 engages the frame 631 for reciprocation. The guiding block 638 has a transverse guiding slot 638*a*, in which a sliding block 639 is received for reciprocation. The control bar 637 has an end pivoted on a back board 631*a* of the frame 631, and connected to a linkage 640, which has an end pivoted on the sliding block 639. The control bar 637 is operated to be swung between a first position P1 (FIG. 4) and a second position P2 (FIG. 8) to move the sliding block 639 along the guiding slot 638*a*, so as to move the cutter 636 in a vertical direction between a pre-cut position S1 (FIG. 4) and a post-cut position S2 (FIG. 8). In order to have a clear showing of the elements of the present invention, the back board 631*a* is omitted in some drawings The cutter 636 has a blade edge 636*a* and a body 636*b*. The blade edge 636*a* is oblique to the sustaining face 613*a*, and an angle between the blade edge 636*a* of the cutter 636 and the sustaining face 613*a* is between 0 and 90 degrees. The angle of the blade edge 636*a* of the cutter 636 is determined by the window covering 200 to be cut. A preferable angle between the blade edge 636*a* of the cutter 636 and the sustaining face 613*a* is 45 degrees. While the cutter 636 is being moved from the pre-cut position S1 to the post-cut position S2, the first rail 201, the covering material 202, and the second rail 203 of the window covering 200 are cut by the lade edge 536*a* in sequence. As a result, the window covering 200 is cut in an easy way when the cutter 636 is moved to the post-cut position S2 from the pre-cut position S1. Besides, in order to ensure the cutting quality, the cutter 636 is parallel to an edge of the non-rigid pad 613, and is very close to the edge when the cutter 636 arrives at the post-cut position S2 to provide the window covering a strong support. While the blade edge 636*a* of the cutter 636 passes through the cutting slot 612*a*, the body 636*b* would abut against the edge of the non-rigid pad 613 that makes the window covering 200 have a flat cutting facet. In the event that the cutter 636 might cut the sustaining face 613*a* of the non-rigid pad 613 if the cutter 636 is tilted. The property of the non-rigid pad 613 would protect the blade edge 636*a* from being damaged. In the present invention, the non-rigid pad 613 is made of reinforced plastics, which is softer than the blade edge 636*a* of the cutter 636. In practice, any material softer than the blade edge 636*a* could be selected to be the non-rigid pad 613.

Figure 6:
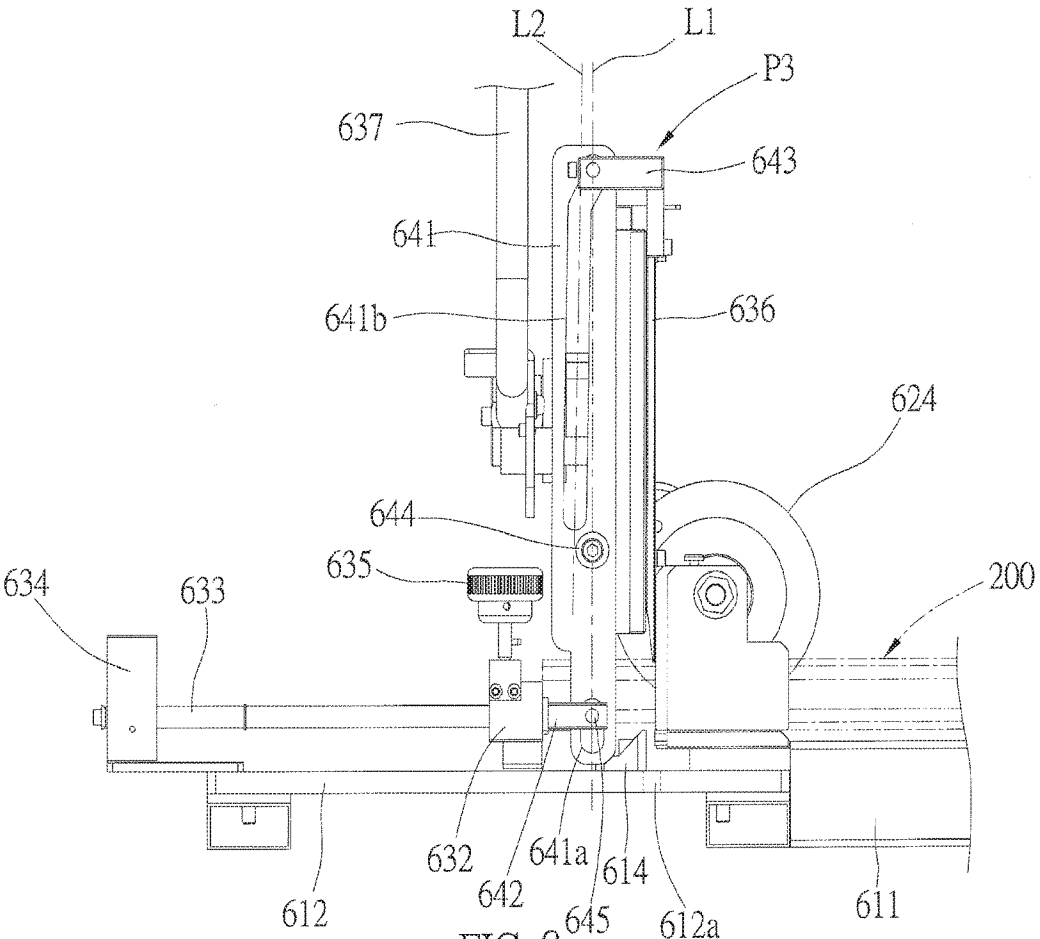
FIG. 6 is a right view of FIG. 3, showing the movable block at the third position.

As shown in FIG. 1 and FIG. 6, the cutting device 630 further includes a connecting bar 641, a connecting block 642, and a movable block 643. The connecting bar 641 is pivotally connected to the frame 631 by a pin 644. The connecting block 642 has an end fixed to the bar 633. A rod 645 is transversely connected to the connecting block 642, and engages a slot 641*a* of the connecting bar 641. Since the stopping blocks 632 are fixed to the bars 633, the connecting bar 641 is linked to the stopping blocks 632 through the connecting block 642. The connecting bar 641 further has an elongated slot 641*b*. An axial line L1 and a central line L2 are defined here, wherein the axial line L1 is an imaginary line perpendicular to the sustaining face 613*a*, and the central line L2 is an imaginary line passing through a long axis of the elongated slot 641*b*. The central line L2 of the elongated slot 641*b* is oblique to the axial line L1. In other words, when the cutter 636 is at the pre-cut position S1 and the connecting bar 641 is upright, there still is a small angle between the elongated slot 641*b* and the axial line L1 to make the elongated slot 641*b* oblique.

Figure 9:
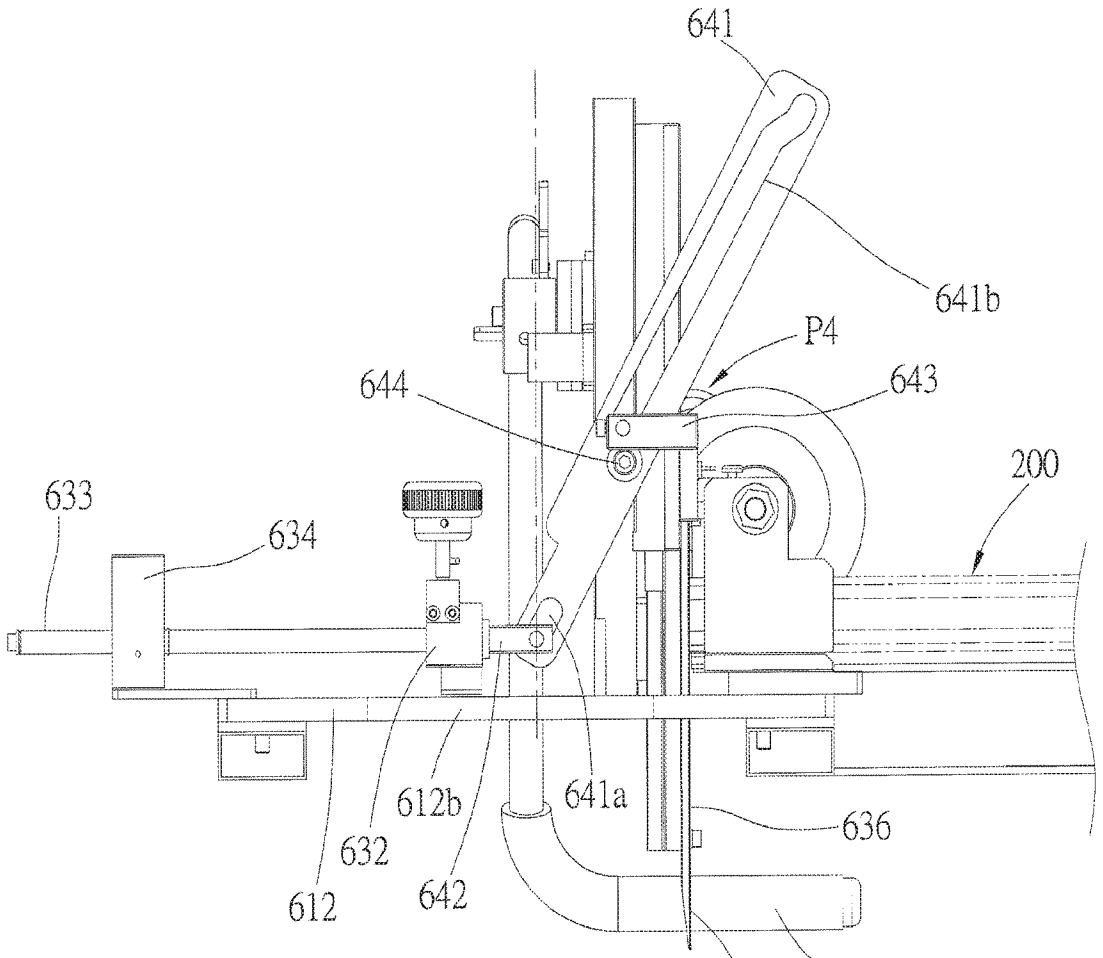
FIG. 9 is a right view of FIG. 3, showing the movable block at the fourth position.

The movable block 643 is fixed to the guiding block 638, and has a portion received in the elongated slot 641*b*. While the control bar 637 is swung between the first position P1 and the second position P2 to move the cutter 636 between the pre-cut position S1 and the post-cut position S2, it will move the movable block 643 along the elongated slot 641*b* between a third position P3(FIG. 6) and a fourth position (FIG. 9). For the movable block 643 at the third position P3, the connecting bar 641 moves the stopping blocks 632 approaching the cutter 636. At this time, the stopping blocks 632 are a stopper of the window covering 200, which is, the window covering 200 has an end abutting against the stopping blocks 632 for positioning. On the contrary, when the movable block 643 is moved toward the fourth position P4, with the design of the oblique elongated slot 641*a*, it could push the connecting bar 641 outwards to move the stopping blocks 632 away from the cutter 636. At this time, the discharging opening 612*b* under a space between the guiding surface 614*a* of the guiding board 614 and the stopping blocks 632 gradually enlarges. As a result, the waste part of the window covering 200 after the cutting task would automatically drop off the machine base 610 through the discharging opening 612*b*. On the other hand, the stopping blocks 632 will return to wait for the next window covering when the movable block 643 is moved back to the third position P3.

Figure 10:
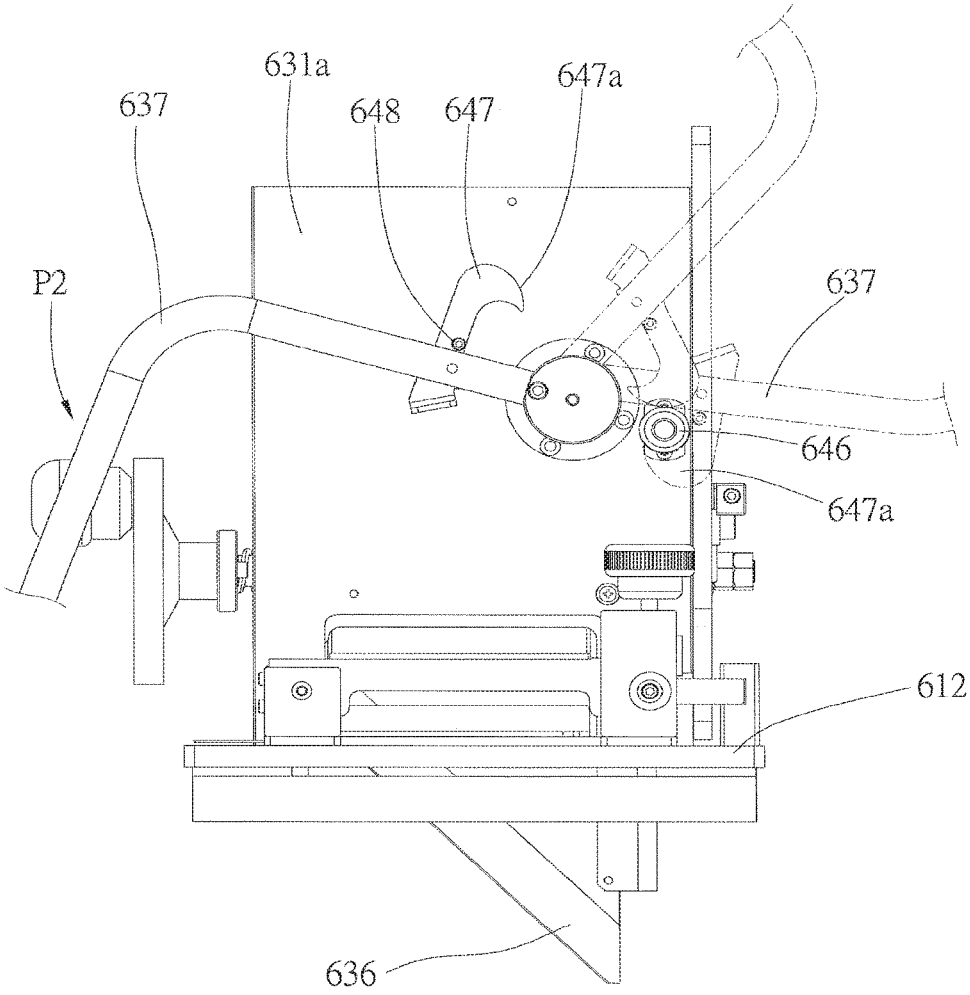
FIG. 10 is a front view of FIG. 3, showing the relationship of the locker and the positioning post.

The cutting device 630 further includes a positioning post 646 and a locker 647. As shown in FIG. 1, FIG. 8, and FIG. 10, the positioning post 646 is fixed to the back board 631*a* of the frame 631, and the locker 647 is an L-shaped plate pivoted on the control bar 637 to be operated. The locker 647 has a hook 647*a* at an end thereof, and the hook 647*a* has a round edge. The hook 647*a* of the locker 647 engages the positioning post 646 when the control bar 637 is moved to the first position P1 (FIG. 4) to prevent the control bar 637 from being moved unexpectedly. On the contrary, if the locker 647 is moved to disengage the hook 647*a* with the positioning post 646, the control bar 637 is free to be moved to the second position P2 (FIG. 8 and FIG. 10) that will move the cutter 636 downwards for the cutting task.

The locker 647 is fixed with a stopping member 648, which is a bolt for example in the present invention, to separate the control bar 638 from the hook 647*a* of the locker 647. As a result, when the control bar 637 is swinging toward the first position P1 from the second position P2 (FIG. 10), the hook 647*a* will not touch the control bar 637, and keeps in a suspended status. It would makes the round edge of the hook 647*a* abut against the positioning post 646. While the control bar 637 continually approaches the first position, it will move the locker 647 to make the hook 647*a* automatically engage the positioning post 646 because of gravity. As a result, the control bar 637 is locked automatically when the control bar 637 arrives at the first position P1.

In conclusion, the cutting machine 100 provides the blade edge 636*a* of the cutter 636 oblique to the sustaining face 613*a* that would make the window covering have a nice cutting facet. For the sustaining face 613*a* of the non-rigid pad 613 softer than the blade edge 636*a* of the cutter 636, it could protect the blade edge 636*a* and elongate the life of the cutter 636. The unique clamping device 620 of the present invention provides a consistent pressure to all kinds of the window coverings. It could avoid the bad effect while the pressure to the window coverings is too large or too small. The cutting machine 100 of the present invention further provides the safe design, which avoid the cutter from be activated unexpectedly, and auto-discharging function. It is a nice design.

It must be pointed out that the embodiments described above are only some preferred embodiments of the present invention. All equivalent structures which employ the concepts disclosed in this specification and the appended claims should fall within the scope of the present invention.

What is claimed is:

1. A cutting machine for cutting a window covering, wherein the window covering includes a first rail, a covering material, and a second rail, comprising:

a machine base having a sustaining face for sustaining a part of the window covering; and a cutting device provided on the machine base, and including a cutter, which is controllable to reciprocate in a direction substantially perpendicular to the sustaining face, wherein the cutter has a blade edge, and an angle is formed between the blade edge and the sustaining face to cut the first rail, the covering material, and the second rail in sequence, whereby another part of the window covering not sustained by the sustaining face becomes a cut-off part after the window covering being cut;

and wherein the machine base is provided with a non-rigid pad, which forms the sustaining face;

wherein the cutter crosses an edge of the non-rigid pad and is adjacent to the edge of the non-rigid pad when the cutter is moved to cut the window covering;

wherein, the machine base further includes a rigid board and a guiding board; the non-rigid pad and the guiding board are fixed to the rigid board.

2. The cutting machine of claim 1, wherein the angle between the blade edge and the sustaining face is between the 0 and 90 degrees.

3. The cutting machine of claim 1, wherein a cutting slot is formed between the non-rigid pad and the guiding board for the cutter to pass therethrough; the rigid board is provided with a discharging opening, which is lower than the sustaining face; and the cut-off part of the window covering after being cut leaves the machine base through the guiding board and the discharging opening in sequence.

4. The cutting machine of claim 1, wherein the cutting device further includes a frame and a control bar; the cutter is slidably connected to the frame for reciprocation; the control bar is pivoted on the frame to be moved between a first position and a second position; and the cutter is moved by moving the control bar.

5. The cutting machine of claim 4, wherein the cutting device further includes a positioning post and a locker; the positioning post is fixed to the frame; the locker is pivoted on the control bar; the locker has a hook to engage the positioning post when the control bar is moved to the first position, and disengage the positioning post when the control bar is moved to the second position.

6. The cutting machine of claim 5, wherein the cutting device further includes a stopping member fixed to the locker to separate the control bar from the hook.

7. The cutting machine of claim 5, wherein the hook of the locker has a round edge to abut against the positioning post and move the locker off when the control bar is being moved to the first position from the second position, and then the locker automatically moves back to engage the positioning post because of gravity when the control bar arrives at the first position.

8. The cutting machine of claim 4, wherein the cutting device further includes a connecting bar, a stopping block, and a movable block; the connecting bar is pivotally connected to the frame to drive the stopping block to reciprocate along the machine base; the connecting bar has an elongated slot; the elongated slot is oblique to an axial line, which is perpendicular to the sustaining face; the movable block has a portion received in the elongated slot to be moved along with the control bar between a third position and a fourth position; the movable block drives the connecting bar to move when the movable block is moved between the third position and the fourth position; the connecting bar drives the stopping block to move toward the cutter when the movable block is moved to the third position, and the connecting bar drives the stopping block to move away from the cutter when the movable block is moved to the fourth position.

9. The cutting machine of claim 8, wherein the cutting device further includes at least one bar; the at least one bar has an end proximal to the sustaining face and an end distal to the sustaining face; the stopping block is connected to the at least one bar, and is movable on the at least one bar and fixed at a position by operating a knob.

10. The cutting machine of claim 1, further comprising a clamping device having two fixed bases, a clamping block, a screw bar, an operating wheel, and a spring; the fixed bases are mounted on the machine base, the clamping block is movable between the fixed bases, the screw bar is rotatably mounted on the fixed bases while the clamping block is screwed with the screw bar, and the operating wheel is fixed to an end of the screw bar; the spring fits the screw bar and has opposite ends urging the operating wheel and one of the fixed bases, whereby the clamping block is moved between the fixed bases by turning the operating wheel.

11. The cutting machine of claim 10, wherein the clamping device further includes a first stopping block and a second stopping block; the first stopping block is fixed to the operating wheel, and the second stopping block is fixed to one of the fixed bases near the operating wheel; when the clamping block clamps the window covering by turning the operating wheel, the clamping block stops further moving and clamping even when the operating wheel is further being turned, while the screw bar is turned and moved toward the direction away from the operating wheel; further turning of the operating wheel will make the first stopping block abut against the second stopping block to stop the further turning of the operating wheel.

* * * * *